United States Patent [19]

Fog et al.

[11] 4,148,464

[45] Apr. 10, 1979

[54] FASTENING FOR A HYDRAULIC MOTOR

[75] Inventors: Ernst Fog, Glostrup; Carl J. Jepsen, Albertslund, both of Denmark

[73] Assignee: Nordiske Kabel- og Traadfabriker A/S, Copenhagen, Denmark

[21] Appl. No.: 745,670

[22] Filed: Nov. 29, 1976

[51] Int. Cl.[2] ..... B66D 1/00

[52] U.S. Cl. ..... 254/150 FH; 242/117; 254/186 R

[58] Field of Search ..... 254/150 R, 150 FH, 186 R; 180/146, 147, 66 F; 242/117; 248/15, 16, 22, 23, 179

[56] References Cited

U.S. PATENT DOCUMENTS

| | | | |
|---|---|---|---|
| 1,577,251 | 3/1926 | Coyle et al. | 254/150 R |
| 3,244,405 | 4/1966 | Hanning | 254/186 R |
| 3,439,766 | 4/1969 | Dence et al. | 180/66 F |
| 3,788,605 | 1/1974 | Johnson | 254/150 FH |
| 3,948,488 | 4/1976 | Brockelsby | 254/186 R |

FOREIGN PATENT DOCUMENTS

| | | | |
|---|---|---|---|
| 1145972 | 3/1969 | United Kingdom | 248/15 |

*Primary Examiner*—Francis S. Husar
*Assistant Examiner*—D. W. Underwood
*Attorney, Agent, or Firm*—Strauch, Nolan, Neale, Nies & Kurz

[57] ABSTRACT

A hydraulic motor is located inside a drum which is shown as a capstan. The motor is mounted in a support tube/rod unit which in turn fastens to the fixed support using a three point fastening flange. The motor is fastened with its drive shaft facing away from the fixed support and directly connected to one end of the drum, the other end of the drum being journalled on the support tube/rod assembly. Both ends of the drum can be journalled on the support tube/rod. Suitable hydraulic lines can be passed through the support tube/rod assembly to power the hydraulic motor.

4 Claims, 2 Drawing Figures

FASTENING FOR A HYDRAULIC MOTOR

From a French Pat. No. 1.033.664 it is known how to fasten a hydraulic motor inside a pulley which forms the hub of a combined traction- and steering wheel for a three-wheeled vehicle. The traction- and steering wheel is carried in both pronges of a fork, which is turnable around a vertical axis. In order to transmit power from the shaft of the hydraulic motor to the surrounding pulley, it has been necessary to use a planetary gear.

Due to its fastening inside the wheel hub, this hydraulic motor is extremely space-saving, but the necessity of using a planetary gear as transmission from the hydraulic motor to the wheel is a disadvantage that limits the utility of this fastening.

The present invention is related to the fastening of a hydraulic motor, in which the known space-saving characteristic is maintained, but in which the limitation of using a planetary gear for transmission is avoided.

This is achieved according to the invention by the combination of the following characteristics:

(1) The hydraulic motor is fastened in such a way that the drive shaft is facing away from a fixed frame, (2) the hydraulic motor is fastened in a carrying tube adjoining a carrying rod, which is concentric to the motor shaft, (3) the carrying rod is fastened to the fixed frame, preferably using a three point leveling adjustment, (4) the carrying tube and carrying rod contain bores or carry pipes for the supply of the hydraulic power, and (5) the drum is at one end fastened to the drive shaft of the motor and at the other end it is connected to the carrying rod through a bearing.

The drum surrounding the hydraulic motor may thus be run directly from the shaft of the hydraulic motor without insertion of any planetary gear and in addition it is achieved that the drum has become one-sidedly fastened, enabling the wheel to be formed as a capstan, around which a hauling rope may be laid and tightened for hauling in. Thus the fastening according to the invention gains increased utility.

Figure 1:
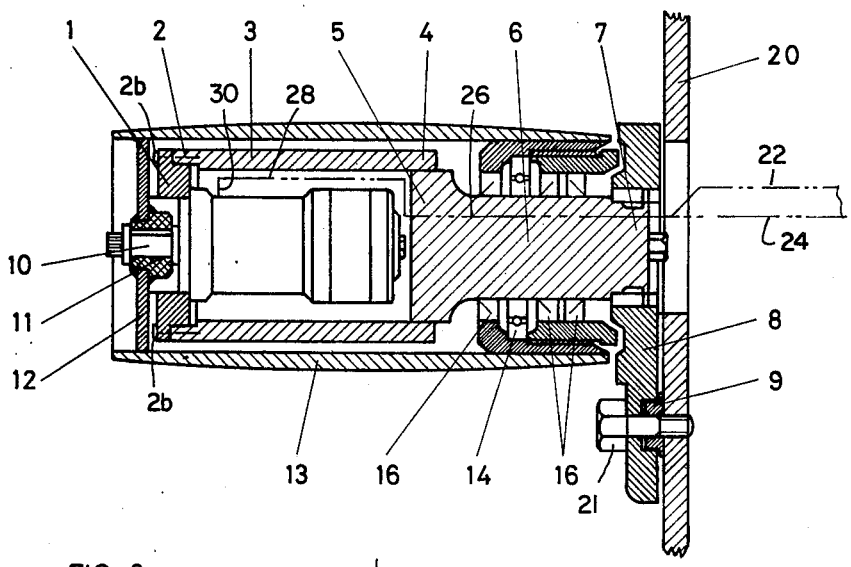
Figure 2:
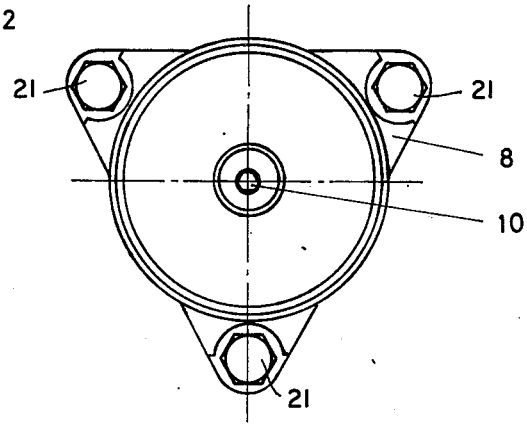

In order that the invention may be fully understood and readily carried into effect, one way of realization will now be described with reference to the accompanying drawings of which:

FIG. 1 shows an axial section of a motor fastening according to the invention and FIG. 2 shows the three point fastening of the capstan motor, seen from the shaft end.

In FIG. 1, 1 is a fastening flange for a hydraulic motor of the orbit type.

This flange 1 is fastened to one end 2 of a carrying tube by means of screws 2*b*, as indicated with a dotted line. The other end of the carrying tube is adjoining one end 5 of a carrying rod 6. The other end 7 of this carrying rod is fastened via a flange 8, which is clearly shown in FIG. 2.

As shown on FIG. 1, three machine screws 21, cooperating with flanged bushings 9 for leveling adjustments, are used in order to fasten the flange 8 to a fixed frame 20, not further shown. A capstan 13 is at one end carried by an end plate 12, in which there is a bore 11 for fastening the drive shaft 10 of the motor. The other end of the capstan 13 is carried by a bearing 14 the fixed race of which is resting on the carrying rod 6. Seals 16 are placed on both sides of the bearing 14.

The hydraulic motor is supplied with fluid, such as oil under pressure, through seals and pipes (tubes) or bores in the carrying tube 3 and the carrying rod 6 such as schematically shown by fluid communication lines 22, 24, 26, 28 and 30 in FIG. 1.

In order to improve the clarity of the illustration, connections for pressure- and waste oil are not shown. In order to relieve the axle bearing of the hydraulic motor, an extra support bearing (not shown) may be placed between the end 2 of the carrying tube 3 and the capstan 13.

As examples of purposes for the fastening according to the invention, seine pulleys for fishing boats, rope pulleys, mooring capstan and sheet winch for ships may be mentioned.

The fastening would be extremely suitable when used as driving means for band conveyors, portable as well as stationary ones such as escalators.

What we claim is:

1. Fastening means for securing a motor drum assembly to a support structure, the motor drum assembly comprising a hydraulic motor with a projected rotary drive shaft and a rotatable drum enclosing said motor, the axes of the drum and motor being coaxial; said motor drive shaft extending away from the support structure; said fastening means comprising a combination rigid assembly of coaxial tubular means and rod means with said rod means projecting from one end of said tubular means, said motor being non-rotatably secured inside of said tubular means with its drive shaft coaxial with said rod means and projecting from said tubular means in the opposite direction from the rod means; means non-rotatably securing said drive shaft to one end of said rotatable drum; said drum encompassing said tubular means; means rotatably jounalling said drum on said rod means; a terminal portion of said rod means projecting from the other end of said rotatable drum; and a flange member rigidly secured to said rod means at the other end of said rotatable drum and adapted to be rigidly secured to the support structure; said fastening means including means enabling fluid communication to said motor to supply drive power to said motor.

2. Fastening means as defined in claim 1, wherein a flange plate is fastened to the other end of said tubular means and said motor is fastened to said flange plate.

3. Fastening means as defined in claim 2, wherein said one end of said drum has an end plate, said flange plate is centrally apertured and said motor shaft projects through said flange plate and is drive connected to said drum end plate.

4. Fastening means as defined in claim 1, wherein said means rotatably journalling said drum includes motor shaft bearing means and a second bearing means disposed between the other end of said drum and said rod means.

* * * * *